United States Patent [19]

Wagner et al.

[11] 3,955,129

[45] May 4, 1976

[54] ARRANGEMENT FOR CONTROLLING SIMULTANEOUSLY SEVERAL ELECTRIC TOYS BY A SINGLE CIRCUIT

[75] Inventors: Karlhorst Wagner, Rothenbach; Hellmut Zorn, Neutras, both of Germany

[73] Assignees: DEG Datensysteme und Electronic Gesellschaft Ingenieurbuero; K. Waegner; H. Zorn, all of Roethenbach, Germany

[22] Filed: Jan. 21, 1974

[21] Appl. No.: 435,118

[30] Foreign Application Priority Data

Feb. 2, 1973 Germany ..... 2305112

[52] U.S. Cl. ..... 318/55

[51] Int. Cl.[2] ..... H02P 7/68

[58] Field of Search ..... 318/16, 55, 80

[56] References Cited

UNITED STATES PATENTS

| | | | |
|---|---|---|---|
| 1,778,465 | 10/1930 | Ozane | 318/80 X |
| 3,070,732 | 12/1962 | Crandall et al. | 318/55 |
| 3,211,111 | 10/1965 | Morley | 318/16 UX |
| 3,220,356 | 11/1965 | Leslie | 318/16 UX |
| 3,299,334 | 1/1967 | Ramadan | 318/16 |
| 3,315,613 | 4/1967 | Leslie | 318/16 X |
| 3,355,643 | 11/1967 | Benson | 318/16 X |
| 3,361,082 | 1/1968 | Leslie | 318/16 X |
| 3,448,361 | 6/1969 | Dinter | 318/16 X |
| 3,587,100 | 6/1971 | Doremus | 318/16 X |
| 3,748,564 | 7/1973 | Ohba | 318/16 X |

*Primary Examiner*—Robert K. Schaffer
*Assistant Examiner*—W. E. Duncanson, Jr.
*Attorney, Agent, or Firm*—Frank J. Jordan

[57] ABSTRACT

A system for individually controlling simultaneously several electric model trains on a common track in which one of the trains is controlled in speed and direction by a voltage supply which determines the direction of the train by the polarity of its output voltage. The speed of the train is determined by the amplitude of the output voltage. Additional trains are controlled in both speed and direction by an auxiliary AC voltage supply which is connected to the supply for the first train and which superimposes pulse-waves having a Hf AC component on the voltage output of the supply for the first train. This AC component comprises pulse shaping information for controlling the velocity and direction of the additional vehicles. Such Hf component and pulse-waves are electrically blocked out of the first voltage control of the first train, thereby providing for individual control of the latter; while each additional train is provided with a capacitor for filtering the Hf signal carrying the pulse-waves to individual rectifiers associated therewith for control thereof by pulse shape adjustment.

1 Claim, 6 Drawing Figures

Fig. 1
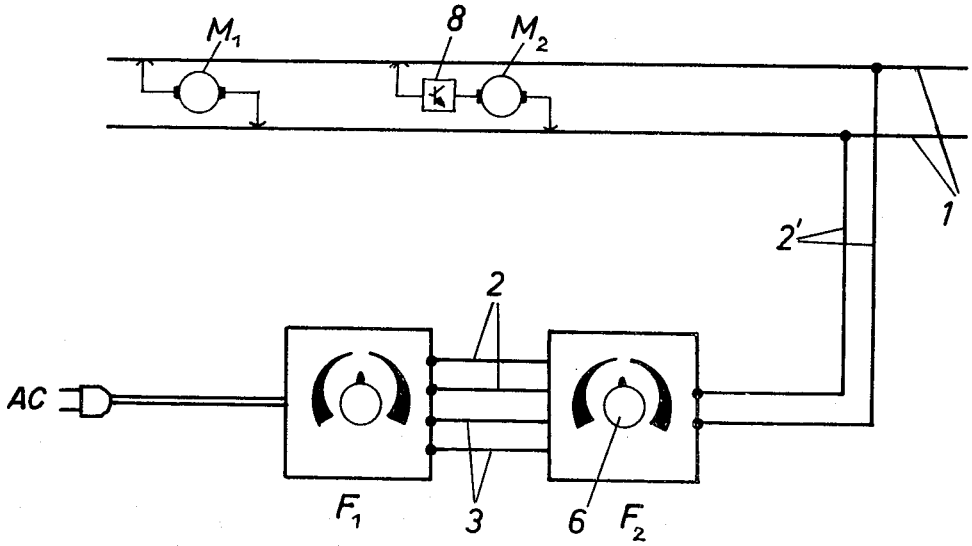
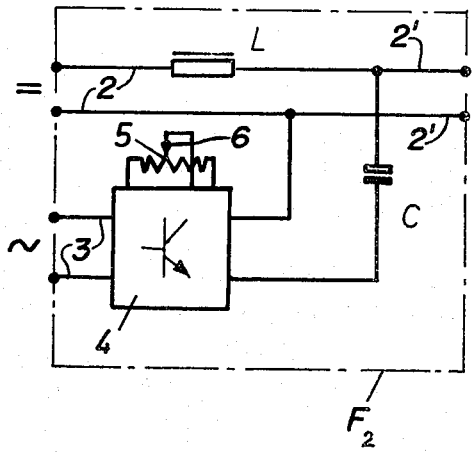
Fig. 2

ARRANGEMENT FOR CONTROLLING SIMULTANEOUSLY SEVERAL ELECTRIC TOYS BY A SINGLE CIRCUIT

BACKGROUND OF THE INVENTION

The present invention relates to a toy vehicle system for simultaneously but individually controlling two or more electrically operated toy vehicles. In particular, the toy vehicles are in the form of electric model trains in which a single circuit is comprising a common track therefor used to control the vehicle direction independently of the vehicle velocity.

A system known in the art for controlling several trains of the above species provides several circuits so that each train is associated with one circuit. Thus a control arrangement for three trains may be realized by the use of an overhead line and a center rail. This center rail serves as the ground or common return conductor, for example, while each of the track rails as well as the overhead line cooperate with the center rail to provide three separate circuits for the three trains. The disadvantage of this system is that it is not possible to rebuild an arrangement which was not originally designed to be used for controlling several trains. This results from the condition that entirely new tracks and additional overhead lines must be installed for such trains which were originally built without the intent for controlling several trains at the same time. It is also a disadvantage of the conventional systems that the number of trains which may be independently controlled is limited.

An arrangement is also known in the art which adapts single-train control to controlling several trains by applying a regulated constant voltage (AC or DC) to both rails. A separate HF AC voltage is superimposed on the constant voltage for each locomotive which is to be controlled. Each locomotive has, in turn, a HF tuned receiver which enables the locomotive selectively to be controlled. Frequency control thus is used for the purpose of switching the trains between forward and reverse drives. Further control for the locomotives is determined by the amount of current taken from the rail circuit to which constant voltage is supplied for driving the locomotives. The actual energy for driving several trains is derived from the constant voltage applied to each train by the rail circuit.

The preceding conventional arrangement has the same disadvantage as the known arrangements based on half-wave control which is adapted only for two train operation. This disadvantage resides in the requirement that several or all locomotives must be supplied with corresponding control installations for operating their electrical motors. Thus, it is not possible, to convert a common single-train toy arrangement to one which consists of electronically controlled trains, through the use of simple means.

Accordingly, it is an object of the present invention to overcome the disadvantages of such known prior art arrangements and provide a toy vehicle arrangement for individually and simultaneously controlling two or more electrically operated toy vehicles on a common track.

It is a particular object of the present invention to provide a toy vehicle arrangement for electrical model trains which are controlled by a single circuit so that the vehicle direction is independent of the vehicle velocity.

Another object of the present invention is to provide a toy vehicle arrangement of the foregoing character in which extensive rebuilding of single-train arrangements is not essential for adaptation to multiple-train operation.

The objects of the present invention are achieved by providing that the first toy vehicle is driven in the conventional manner by AC current, DC current, or rectified AC current. The velocity of such first toy vehicle is controlled by varying the voltage amplitude, whereas the vehicle direction is controlled by switching the polarity. The vehicle direction of such first toy vehicle may also be determined by applying a relatively high voltage to the applied driving circuit. Each additional toy vehicle receives its driving energy as well as the control information for direction and velocity in the form of a supply voltage consisting of an AC component superimposed upon the supply voltage for the first toy vehicle. The frequency of this AC component is substantially greater (2X, for example) than the frequency (60H, for example) of the utility line outlet supply. It is to be understood thereby that each additional toy vehicle is to be associated with a different frequency of the superimposed AC component.

In the following description, the expression "supply voltage" is to denote the supply voltage used to drive the first toy vehicle. The expression "AC supply voltage" is to denote a low frequency AC voltage used for driving an additional toy vehicle. The frequency of this AC supply, however is substantially higher than the frequency (25–60H) of the utility line outlet supply voltage.

The essential difference between the toy vehicle arrangement of the present invention and conventional arrangements for multiple train control resides in the feature that the different AC supply voltages for the additional toy vehicles is not used as previously for selective control of additional toy vehicles which derive all of their driving energy from a common track circuit. Instead, the AC supply voltage in accordance with the present invention, supply simultaneously the energy carrier for actually driving the additional toy vehicles. Through this arrangement, it is possible to obtain a multiple-train control from an original single-train unit, in which a regulated constant supply voltage is not suitable for the track circuit itself, since voltage amplitude variation for controlling the first toy vehicle is necessary.

In a further embodiment of the present invention, the velocity of the second vehicle, as well as any additional vehicles, can be controlled by the amplitude of the associated low-frequency basis supply voltage. The vehicle direction can be controlled by the waveform.

For this purpose, each AC supply voltage for an additional toy vehicle may be made advantageously in the form of nonsymmetrical half-waves having a time-average value of substantially zero. In this manner the polarity of the difference voltage of both maximum values can serve for determining the direction of the vehicle. This difference voltage may be obtained in a simple manner by the application of a voltage multiplying circuit with an ohmic voltage divider.

Since the force required to start a toy vehicle is generally substantially greater than the force needed to maintain a uniform velocity, a substantially higher voltage is required by the motor when starting up in comparison with the voltage required for cruising. As a result of this, the toy vehicle as, for example a model train, starts up abruptly from its stationary position and drives with substantially relatively high velocity. This resultant velocity may not be diminished substantially by moving back the operating regulator, since this causes dropping below a predetermined threshold level for stopping the train, whereby the train is immediately stopped in place when this threshold level is not exceeded.

A substantial improvement in the low-speed operating characteristics in the arrangement is achieved, in accordance with the present invention, by providing that the AC supply voltage for the additional toy vehicles has a number of oscillating pulses with relatively low pulse repetition frequency. With this arrangement, a sufficiently large voltage is made available for accelerating purposes and for overcoming frictional resistance. At the same time, the duration of the latter voltage is substantially short and applies, thereby, only an impulse to the toy vehicle. By applying a predetermined pulse repetition frequency as, for example, the frequency which corresponds to that of the utility line outlet supply, a reliable slow start-up of the toy vehicle may be obtained. This is particularly desirable in model trains. For this purpose, it is also possible to make the pulse repetition frequency equal to twice the frequency of the utility line outlet supply.

The use of the pulse drive described above at full speed may lead to undesirably high voltage pulses in the motor, and this may result in poor motor operation as well as a disturbed and noisy fast-driving operation. These undesirable characteristics can be avoided, in accordance with the present invention, by providing that when the amplitude of the AC supply voltage increases, the pulse width also increase at substantially fixed pulse repetition frequency. In this manner, there is always a transition from start-up to a steady-state voltage for full speed when using the preceding pulse driving arrangement.

The frequencies of the AC supply voltages can generally be determined through applied pulse generators or oscillators. The pulse repetition frequency, however, can be obtained in an advantageous manner from the utility line outlet supply frequency. Thus, the pulse repetition frequency may be equal to the utility frequency or to a multiple of this line frequency.

A particularly simple construction, in accordance with the present invention, is obtained when the control console of each additional toy vehicle is connected in series with the line between the control console of the first vehicle and the rail circuit. With this arrangement, the AC supply voltage is superimposed upon the first supply voltage, and all control consoles have a common utility line outlet. Thus, the current supply lines for the first control console are passed through all additional control consoles.

It is also within the framework of the present invention that the AC supply voltages include additional information for actuating mechanical or electrical auxiliary equipment on the toy vehicles. By way of example such information may be directed for the purpose of switching lights on and off, for actuating remote-controlling couplings, or for controlling a crane installation.

The novel features which are considered as characteristic for the invention are set forth in particular in the appended claims. The invention itself, however, both as to its construction and to its method of operation together with additional objects and advantages thereof, will be best understood from the following description of specific embodiments when read in connection with the accompanying drawings.

SUMMARY OF THE INVENTION

An arrangement for controlling simultaneously at least two electrical motor driven toy vehicles includes a source of alternating current, and a first voltage supply means connected to the source of alternating current for driving a first vehicle. The velocity of the first vehicle is controlled by variation of voltage amplitude of the voltage supply means, and the direction of the first vehicle is controlled by variation of the polarity of the first voltage supply means. The velocity of the first vehicle is controllable by the first voltage supply means independently of the vehicle direction. A second voltage supply means for driving an auxiliary or at least a second vehicle and connected to the first voltage supply means is also provided. The second voltage supply means supplies to the second vehicle a voltage having a pulsed low frequency AC component superimposed on the voltage output from the first voltage supply means, and this AC component has a pulse repetition frequency substantially higher (2X, for example) than the frequency of the main source of alternating current. The output voltage from the second voltage supply means not only energizes the drive motor, but contains information for controlling the velocity and direction of the second vehicle.

BRIEF DESCRIPTION OF THE DRAWINGS

FIG. 1 is a schematic diagram which shows the arrangement for controlling two trains in accordance with the present invention.

FIG. 2 is a schematic diagram showing the regulator and current flow for electronically controlling the second train in FIG. 1.

DESCRIPTION OF THE PREFERRED EMBODIMENTS

Figure 3:
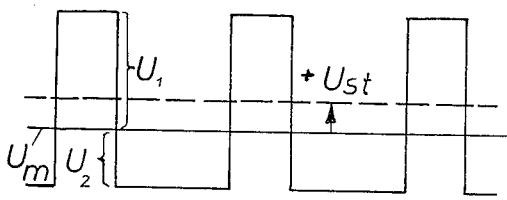
FIG. 3 is a schematic diagram showing a non-symmetrical waveform for the pulsed AC supply voltage for controlling the second train.
Figure 4:
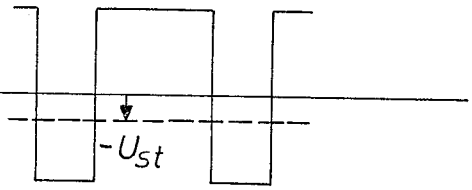
FIG. 4 is an inverted voltage diagram with respect to FIG. 3 and corresponds to a reversed driving direction of the second train.

Referring to the drawing and in particular to FIG. 1, there is shown two rails 1 of a track which provide DC voltage for driving a first train having its driving motor $M_1$ connected to the rails. The DC voltage for driving the motor $M_1$ is controlled in magnitude and polarity by a first console $F_1$ which is connected to an utility outlet supply voltage. This DC control voltage to the driving motor $M_1$ is applied to the rails 1 through the two insulated wire connecting lines 2 and 2'.

A second or auxiliary train is also located on the rails 1, and is provided with a drive motor M2 controlled independently of the first train having the driving motor $M_1$. For the purpose of driving this second train on the same rails 1, independently of the first train, a second control console $F_2$ is connected to the connecting lines 2'. This auxiliary console $F_2$ provides a low-frequency pulsed AC voltage signal which is, however, higher in frequency than the AC voltage supplied by the utility outlet. The AC voltage signal from the control unit $F_2$ is supplied for driving the motor $M_2$ of the locomotive or driving unit of the second train. The second console $F_1$ is connected to the first console $F_1$ through two insulated wire auxiliary lines 3. In this manner, the console $F_2$ does not require an individual utility outlet supply of AC. The basic supply voltage for the second train is capacitively coupled to the connecting lines in the console $F_2$. This capacitive coupling through the application of a capacitor C assures that no DC voltage components of the pulsed AC supply voltage for the second train can reach the connecting lines 2'. In this manner, interference or disturbing effects for driving the first train are avoided. A choke L in the form of an inductor, for example, is connected in the DC line circuit 2–2' for blocking from console F the pulsed AC voltage supply in a reversed manner.

There is provided a frequency stage 4 in the auxiliary console $F_2$ which serves to receive through leads 3, 3 the AC voltage from the first console F1, and to generate a pulsed AC voltage that has a higher frequency than the voltage from the utility outlet supply, but is still, however, in the low-frequency region. The amplitude of the pulsed AC voltage generated by the stage 4 may be regulated by a potentiometer 5 which has its movable contact connected to an operating knob 6 of the console $F_2$. At the center position of the rotatable knob 6, the waveform of the pulsed AC voltage is changed so that the motor $M_2$ for driving the second train is switched from forward drive to reverse drive. Such switching action of the motor $M_2$ may also be achieved, for example, in the alternate manner from reverse operation to forward driving operation.

A receiving circuit 8 of the driving unit of the second train serves to separate the pulsed AC supply voltage from the DC voltage for the first train by means of capacitors. The resultant signal is then applied to a separate rectifier so that variations in amplitude of the AC supply voltage are converted to a variable DC voltage for driving the motor $M_2$ which is also a DC motor.

The information for the desired driving direction is achieved by a special non-symmetrical waveform of the pulsed AC supply voltage that is used. For purposes of simplification and aiding the understanding of the arrangement, this is shown in FIG. 3 in the form of a non-symmetrical rectangular-shaped waveform. The maximum voltage values of the two half-waves of this nonsymmetrical rectangular-shaped voltage are referenced with respect to a time-average value $U_m$. These maximum voltage values are of different magnitude, whereby the level of the time-average value is entirely unobservable. This results from the condition that the DC voltage component is blocked by the capacitor C and conversely, the DC voltage for the first train is again blocked by corresponding capacitors in the receiving circuit 8 of the driving unit for the second train. As a result the time-average value $U_m$ of the non-symmetrical rectangular-shaped voltage has substantially a zero abcissa in the receiving circuit 8 after separation from the DC voltage component. If the pulsed AC supply voltage is to be taken only from the actual AC voltage component and independently of the accompanying DC voltage components, then the criteria for the driving directions is determined through the polarity of the difference voltage $U_{st}$ of the two peak voltages $U_1$ and $U_2$.

As a result of the arrangement described above, the amplitude of the pulsed AC supply voltage has no influence on the polarity of the difference signal $U_{st}$ for controlling the driving direction, so that the information signals for the driving direction and driving speed cannot be influenced in any manner.

Figure 5:
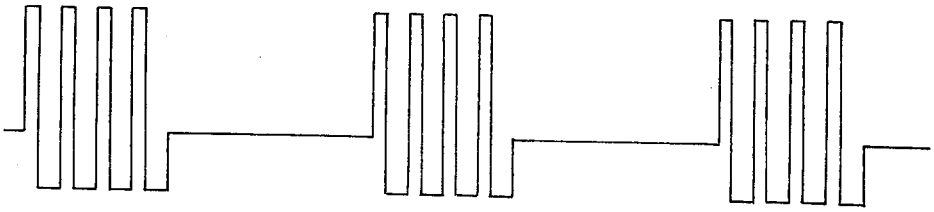
FIG. 5 is a schematic diagram of a pulse train for the AC supply voltage.
Figure 6:
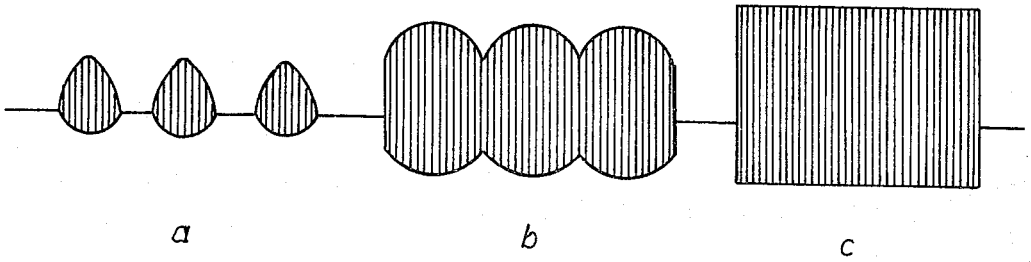
FIG. 6 shows the pulsed AC supply voltage for different velocity regions.

For purposes of improving the slow-driving characteristics of the pulsed AC supply voltage for driving the second train, this AC supply voltage has a number of oscillating pulses with relatively low pulse repetition frequency which is a function of the frequency of the utility outlet supply. This pulse repetition frequency can also correspond substantially to double the frequency of the utility outlet supply. A pulse train of this type is shown in FIG. 5. FIG. 5, furthermore, shows the actual characteristics of the corresponding pulse form which differs from the ideal rectangular-shaped waveform. FIG. 6 shows at a the pulse train for slow-running operation, whereas FIG. 6 shows at b and c the transition from pulse driving operation to analog AC voltage operation at full speed. This transition from pulse to analog AC voltage operation is obtained automatically upon increasing the amplitude. Thus, the circuit arrangement of the frequency stage 4 is such that upon increasing the amplitude of the AC supply voltage, the pulse width of the individual pulses are simultaneously increased at substantially fixed pulse repetition frequency. With this arrangement, it is possible to achieve, on the one hand, an advantageous pulse driven slow-running operation. At high speeds, on the other hand, an analog AC voltage is available for providing quiet driving conditions.

The present invention is not restricted or confined to the embodiment described above. Thus the present invention can be used equally well for other toys as, for example, auto racing vehicles. At the same time, it is also not necessary that the toy vehicle be provided with a direction changing means. In this case, the waveform is either not used or it can be used advantageously for other controlling operations, as for example, switching on and off lights or actuating a rotary mount or junction.

Without further analysis the foregoing will so fully reveal the gist of the present invention that others can, by applying current knowledge, readily adapt it for various applications without omitting features that, from the standpoint of prior art, fairly constitute essential characteristics of the generic or specific aspects of this invention, and therefore such adaptations should and are intended to be comprehended within the meaning and range of the equivalents of the following claims.

What we claim is:

1. A model train system comprising apparatus for converting a conventional single electric model DC train set having a conventional remote control console for operating of such single train from any conventional AC utility current supply outlet on track rails comprising the energizing and control signal circuit thereof; to a multi-train/common track system having an individual remote control console for each train added thereon, so that the trains can be simultaneously and individually controlled in speed and direction without any electrical interference therebetween; comprising an input circuit cable plug for connecting the system to a conventional AC utility outlet source of supply voltage for driving and controlling the conventional train by means of the conventional train control console for starting the conventional train in a selected direction and adjusting the speed thereof by changing the amplitude and polarity direction of the energizing DC voltage applied to said conventional train, as desired;

an additional train mounted to run on said track, comprising a driving unit circuit containing a receiving capacitor circuit acting to separate a selected pulsed supply voltage from the DC voltage applied to said conventional train, and an individual rectifier circuit, whereby variations in amplitude of such pulsed voltage are converted to a corresponding variable DC voltage for energizing the motor of said additional train;

such pulsed supply voltage being of relatively low frequency that is, however, substantially higher than that (25 – 60 H) of said utility AC outlet;

a pulse-wave generator connected to said pulsed supply voltage circuit for applying voltage pulses to the driving unit circuit of said additional train by way of said track; and an auxiliary individual control console for said additional train comprising a potentiometer having a contact movable to either side of center for setting the direction of the polarity and amplitude of the pulses applied to the driving unit circuit of said additional train for controlling the direction and speed of the latter on said track; and capacitor and inductor means associated with said DC and pulsed supply circuits, respectively, for protecting the pulsed circuit from direct current of the former, and for protecting the DC circuit from alternating current of the pulsed supply circuit, when both trains are operated on said track;

such pulsed supply voltage being in the form of non-symmetrical half waves having a time-average value of substantially zero, whereby the difference voltages of both maximum values serves for determining the direction of the so-controlled vehicle;

the pulse repetition frequency being equal to a multiple of that of the AC utility line outlet supply, thereby providing a sufficiently high voltage for reliable starting and acceleration of the additional train, providing that when the amplitude of the supply voltage pulses increases, the pulse width also increases at substantially fixed pulse repetition frequency, whereby smooth transition exists from start-up to full-speed steady-state voltage conditions;

said auxiliary control console of said additional train being connected in series between the circuit for the first train and the rail circuit, so that the pulsed supply voltage circuit is superimposed upon the DC supply voltage, and the control consoles are both connected to the common AC utility outlet.

* * * * *